US009738488B2

(12) United States Patent
Kopp et al.

(10) Patent No.: US 9,738,488 B2
(45) Date of Patent: Aug. 22, 2017

(54) MOBILE HOSE REEL

(71) Applicant: Suncast Technologies, LLC, Palm Beach Gardens, FL (US)

(72) Inventors: Robert G. Kopp, Elburn, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 15/003,934

(22) Filed: Jan. 22, 2016

(65) Prior Publication Data

US 2017/0210590 A1 Jul. 27, 2017

(51) Int. Cl.
*B65H 75/44* (2006.01)
*B65H 75/40* (2006.01)

(52) U.S. Cl.
CPC ..... *B65H 75/4465* (2013.01); *B65H 75/403* (2013.01); *B65H 75/4478* (2013.01); *B65H 2402/42* (2013.01); *B65H 2701/33* (2013.01)

(58) Field of Classification Search
CPC ..... B65H 75/4465; B65H 75/403; B65H 75/4478; B65H 2701/33; B65H 2402/42
USPC ..... 137/355.12, 355.16, 355.26, 355.27; 280/47.18, 47.17
See application file for complete search history.

(56) References Cited

U.S. PATENT DOCUMENTS 32,510 A 6/1861 Burd
427,636 A 5/1890 Swalley
678,413 A 7/1901 Leyland
2,607,608 A 8/1952 Evans
4,512,361 A 4/1985 Tisbo et al.
RE32,510 E 9/1987 Tisbo et al.
4,777,976 A 10/1988 Johnston et al.
4,811,918 A * 3/1989 Grooms ..... B07B 1/48 242/153
D303,446 S 9/1989 Kitts et al.
5,007,598 A * 4/1991 Spear ..... B65H 75/22 137/355.27
5,046,520 A 9/1991 Sanchez, Jr. et al.
5,056,553 A 10/1991 Whitehead et al.
D323,916 S 2/1992 Sanchez, Jr. et al.
D326,549 S 5/1992 Whitehead et al.
5,306,383 A 4/1994 Kobiella
D352,232 S 11/1994 Apgar
(Continued)

*Primary Examiner* — Kevin Murphy
*Assistant Examiner* — Josephine Trinidad-Borges
(74) *Attorney, Agent, or Firm* — McHale & Slavin, P.A.

(57) ABSTRACT

A mobile hose reel traversable between a mobile mode and a stationary mode. The mobile hose reel comprises a first side frame assembly having a first rotatable side wall and a first side frame assembly elongated body. The first side frame assembly elongated body is slidably engaged with at least a portion of the first rotatable side wall and is configured to secure to a first pair of stability members. A second side frame assembly comprises a second rotatable side wall and a second side frame assembly elongated body. The second side frame assembly elongated body is slidably engaged with at least a portion of the second rotatable side wall and is configured to secure to a second pair of stability members. Traversal of the first and second side assemblies upwardly or downwardly about a longitudinal axis traverses the mobile hose reel between a mobile orientation and a stationary orientation.

19 Claims, 19 Drawing Sheets

(56) References Cited

U.S. PATENT DOCUMENTS

| | | | | |
|---|---|---|---|---|
| D352,449 | S | 11/1994 | Rosine | |
| 5,425,391 | A | 6/1995 | Tisbo et al. | |
| D376,096 | S | 12/1996 | Tisbo et al. | |
| 5,657,789 | A | 8/1997 | Tisbo et al. | |
| D392,080 | S | 3/1998 | Tisbo et al. | |
| D409,813 | S | 5/1999 | Tisbo et al. | |
| 5,901,730 | A | 5/1999 | Tisbo et al. | |
| D417,538 | S | 12/1999 | Tisbo et al. | |
| D418,270 | S | 12/1999 | Tisbo et al. | |
| 5,998,552 | A | 12/1999 | Gruber et al. | |
| 6,050,291 | A | 4/2000 | Whitehead et al. | |
| 6,454,281 | B1 | 9/2002 | Pearson | |
| 6,834,670 | B2 | 12/2004 | Rosine et al. | |
| D501,788 | S | 2/2005 | Richardson et al. | |
| 6,877,687 | B2 | 4/2005 | Moon et al. | |
| 6,908,058 | B2 | 6/2005 | Moon et al. | |
| 6,978,797 | B2 * | 12/2005 | Nagler | B65H 75/40 137/355.16 |
| 7,017,603 | B1 | 3/2006 | Rosine et al. | |
| D530,875 | S | 10/2006 | Rosine et al. | |
| D561,010 | S | 2/2008 | Anderson et al. | |
| D575,025 | S | 8/2008 | Anderson et al. | |
| D580,621 | S | 11/2008 | Anderson et al. | |
| D737,669 | S | 9/2015 | Anderson et al. | |
| 2006/0070817 | A1 * | 4/2006 | Campbell | B66F 11/04 187/238 |
| 2014/0352808 | A1 * | 12/2014 | Liu | B65H 75/42 137/355.27 |

* cited by examiner

MOBILE HOSE REEL

FIELD OF THE INVENTION

The present invention relates to a device for storing and managing a hose; and more particularly to a portable hose reel device for easy of storing and transporting a hose.

BACKGROUND OF THE INVENTION

Garden hoses are a necessity for homeowners for lawn and garden care, as well as general all-around home care. Typically, hoses are found either wound and left on the ground near a water spigot, or wound on one of many known hose reel-type storage devices. These devices include portable hose reel carts, stationary frames, and stationary hose reel hangers that can be mounted to a surface of a building, such as an outer wall of a house. A typical portable hose reel cart, or frame, includes a rotatable reel or spool in which a hose is wrapped around, positioned between a pair of fixed side frames. The fixed side frames are designed to provide support for the various other components that make up the hose reel cart. The hose reel cart may further contain a pair of hubs which are coupled to the housing structure. Common hose reel assemblies may also contain a crank for rotating the reel or spool such that the hose can be wound or unwound about the spool. To provide for flow of water from a water source to the hose, hose reel structures further contain water conduits. Typical water conduits have a movable outlet tube and a generally stationary inlet tube. The stationary inlet of the conduit extends away from the reel and is structured to be coupled to a supply hose, which is further coupled to a water supply. The movable outlet of the conduit is disposed on the circumference of the reel. An outlet hose is coupled to the movable outlet and is used to deliver water to the end use. The hose is merely wound upon the reel for storage, and pulled or dispensed from the reel for use. These carts include wheels to permit ready transport of the hose from one location to another.

Water hoses are used to transfer water from one location to another, a necessity for homeowners attempting to efficiently water lawns and gardens, as well as for general all-around home care. Before the use of hose reel storage systems, water hoses were typically left on the ground in a coiled or uncoiled position, either such position exposing the hose to the collection of dirt. If the hose was lifted from the ground, the hose may be stored in an arrangement that would lead to early degradation. The advent of hose reels gained wide public acceptance as a convenient device for properly storing hoses. These devices include portable hose reel carts, stationary hose reel carts, and stationary hose reel hangers that can be mounted to a surface of a building, all of which store the water hoses in a location in a convenient area for reuse. The hose reel provided proper coiling of the hose, positioning off of the ground, and in many instances, portability in a storage condition.

Hose carts are commonly purchased by the general consumer, wherein it is desirable that the hose cart can be easily assembled with minimal use of hand tools. In an effort to provide easy-to-assemble hose reel assemblies, they are typically made of plastic and sold with as many preassembled parts as possible. While such efforts have provided the general consumer with a product that is ready to use out of the box, disassembly for maintenance or repair can be difficult for some consumers. For example, in some prior art devices, users have difficulty in securing the reel hub which is necessary for the introduction of water.

A typical portable hose reel cart includes an open, rotatable reel or spool positioned between a pair of side frames. These carts include wheels to permit ready transport of the hose from one location to another. The hose is merely wound upon the reel for storage and pulled or dispensed from the reel for use.

The construction of a hose reel is primarily of molded plastic components having a rotatable spool for wheeling of the flexible hose, a frame for supporting the spool, and a means for rotating the spool, most commonly performed by a manually operated hand crank. Illustrations of the structure and operation of hose reels and hose reel carts can be viewed and referenced to various patents issued to the Suncast Corporation, such as Reissue 32,510; U.S. Pat. Nos. 4,512,361; 4,777,976; 5,046,520; 5,901,730; 5,998,552; 6,050,291; 6,834,670; 6,877,687; and 7,017,603, the disclosures of which are hereby incorporated by reference.

Common to such hose reels is the use of a crank handle secured to a hub for rotation of the spool. The spools are typically arranged with the crank handle located at the center of the hub to wind the flexible hose. Variations to the use of the hand crank include a battery powered hose reel wherein a small direct current motor obtaining power from a rechargeable battery supply can be coupled to the spool, providing rotation. In many instances, manual rotation of the spool is not convenient to the consumer. For instance, the consumer may require automatic hose take-up due to a physical ailment, or the consumer may simply choose to have the convenience of automatic hose take-up. U.S. Pat. No. 6,877,687 is directed to a battery powered hose reel to provide an alternative to manual cranking of a hose reel. The battery powers a low draw motor, allowing hundreds of hose retrievals before recharging; recharging may be performed by coupling to an electrical source such as an AC source or DC solar panel supplied current.

While some hose reel assemblies are movable through attachment of wheels to the base frame, such units can be clumsy and require additional parts to be manufactured and assembled.

Therefore, what is needed in the art is an improved hose reel which can be constructed using a minimal number of components, is portable, and can traverse between a stationary mode and a mobile mode to provide easy storage and transportation of a hose.

SUMMARY OF THE INVENTION

Disclosed is a mobile hose reel that is traversable between two positions, a mobile position and a stationary position. The mobile hose reel traversable between a mobile mode and a stationary mode may comprise a first side frame assembly having a first rotatable side wall and a first side frame assembly elongated body. The first side frame assembly elongated body is sized and shaped to slidably move within at least a portion of the first rotatable side wall. The first side frame assembly elongated body has a first portion configured to secure to a first end of an elongated bar and a second portion configured to secure to a first pair of stability members. The mobile hose reel further has a second side frame assembly comprising a second rotatable side wall and a second side frame assembly elongated body. The second side frame assembly elongated body is sized and shaped to slidably move within at least a portion of the second rotatable side wall. The second side frame assembly elongated body has a first portion configured to secure to a second end of an elongated bar and a second portion configured to secure to a second pair of stability members.

A spool assembly comprising a hub having a first radial expanding flange attached at one end and a second radial expanding flange attached at a second end is sized and shaped to receive an elongated flexible hose. Traversal of portions of the first side frame assembly and the second side frame assembly upwardly or downwardly about a longitudinal axis traverses the mobile hose reel between a mobile orientation and a stationary orientation.

Accordingly, it is an objective of the instant invention to provide a portable hose reel.

It is a further objective of the present invention to provide a portable hose reel having a mobile configuration.

It is yet another objective of the present invention to provide a portable hose reel having a stationary configuration.

It is a still further objective of the invention to provide a portable hose reel that traverses between a mobile configuration and a stationary configuration.

It is a further objective of the present invention to provide a portable hose reel having side frames configured to allow the hose reel to move upon a surface.

It is yet another objective of the present invention to provide for a portable hose reel having retractable legs.

It is a still further objective of the invention to provide a hose reel having side frames that rotate.

It is a further objective of the present invention to provide a hose reel having side frames that rotate independently from a hose reel assembly.

It is yet another objective of the present invention to provide a portable hose reel having retractable arms.

It is a still further objective of the invention to provide a portable hose reel having telescoping arms.

It is a further objective of the present invention to provide retractable or telescoping arms that rotate about the circumference of the side frames.

It is yet another objective of the present invention to provide retracting legs sized and shaped to maintain the hose reel in a stationary mode.

It is a still further objective of the invention to provide retracting legs coupled to retractable or telescoping arms.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features, thereof.

DETAILED DESCRIPTION OF THE INVENTION

Figure 1:
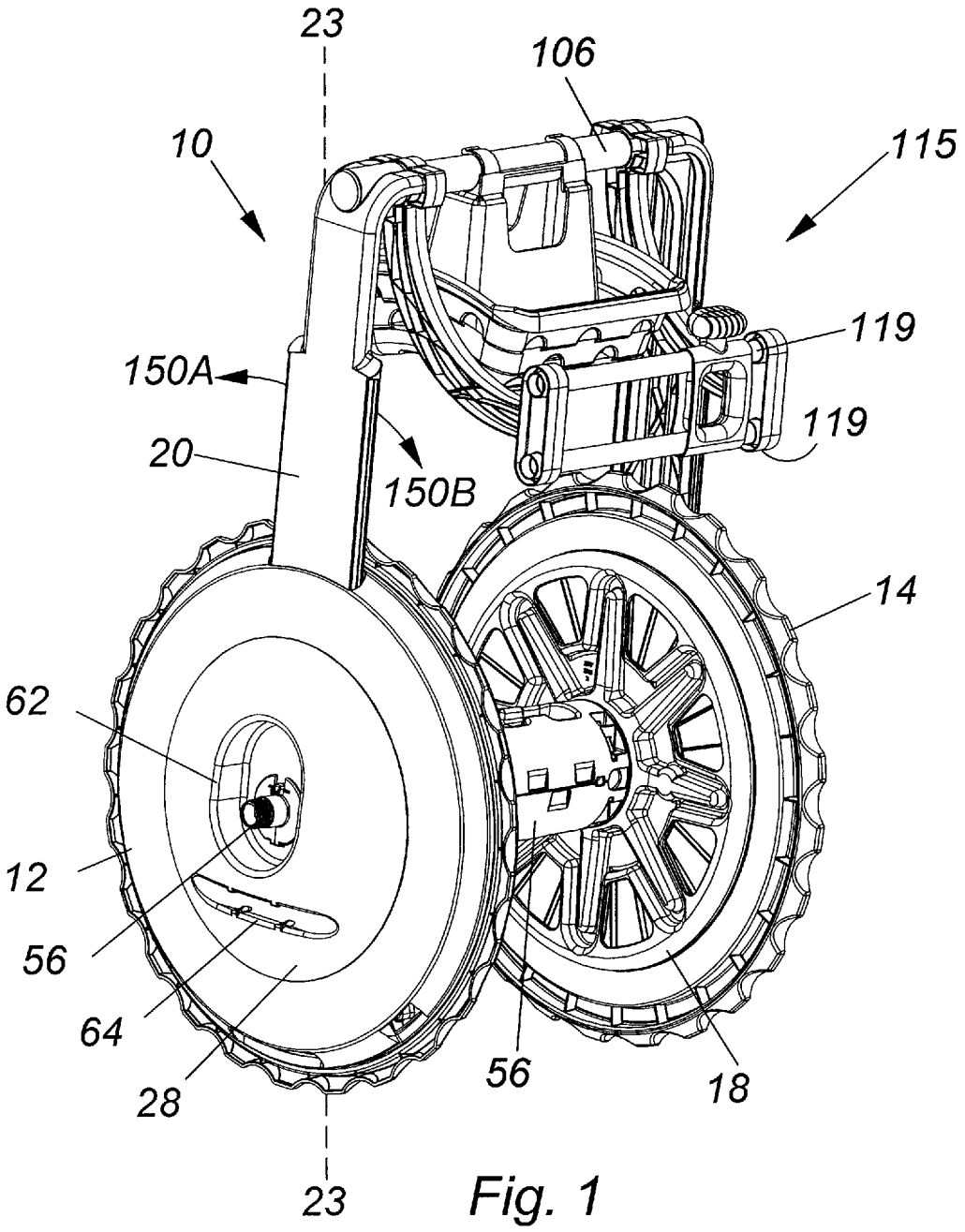
FIG. 1 is a front perspective view of an in-tube side of an illustrative embodiment of a mobile hose reel, shown in the mobile mode.
Figure 2:
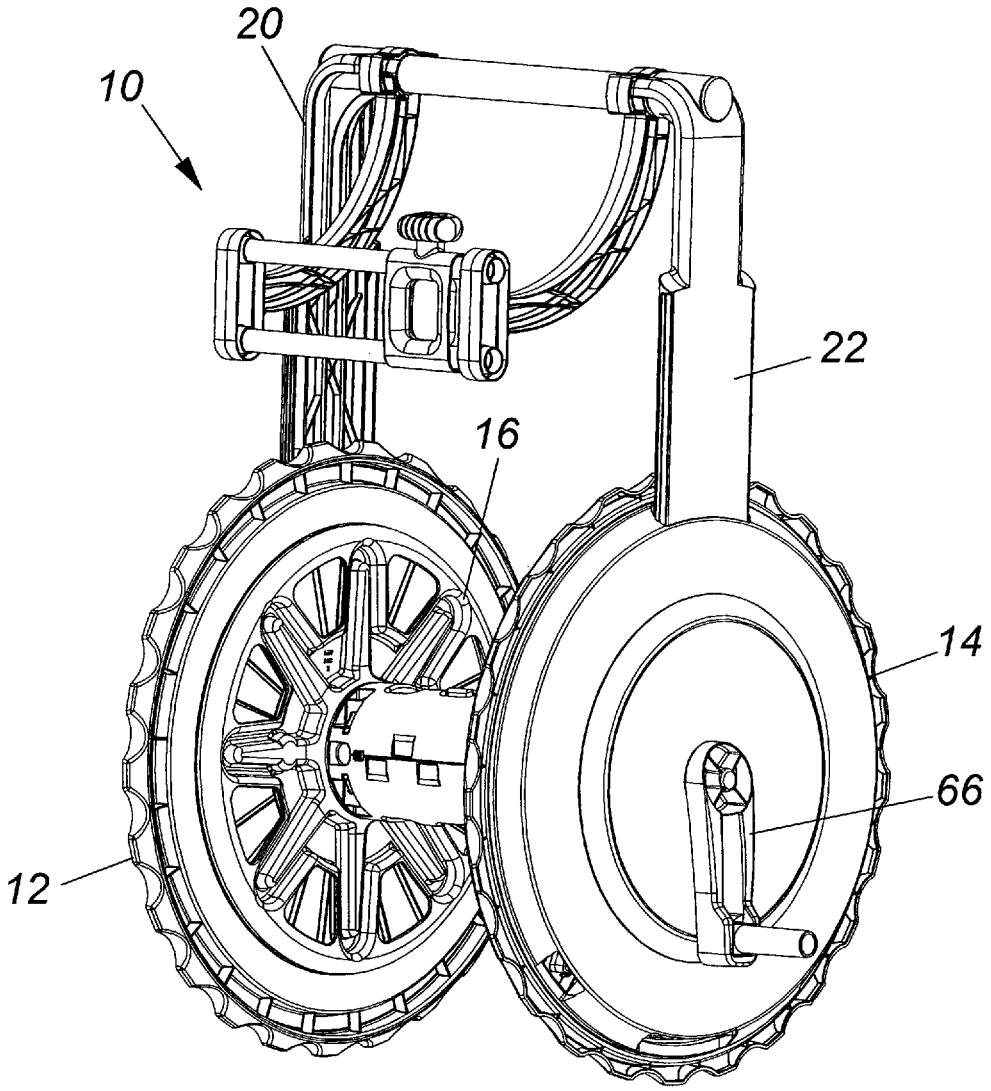
FIG. 2 is a front perspective view of a crank side of the mobile hose reel, shown in the mobile mode.
Figure 3:
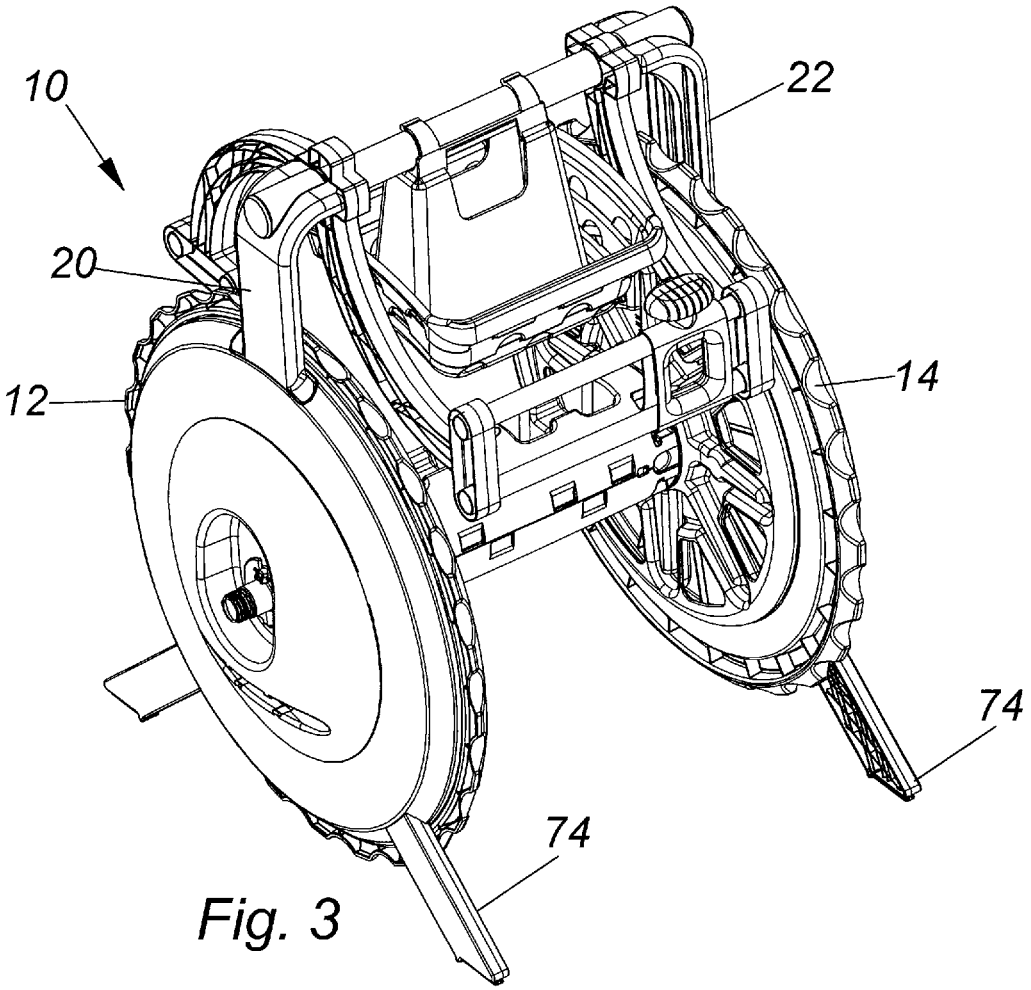
FIG. 3 is a front perspective view of the in-tube side of the mobile hose reel, shown in the stationary mode.
Figure 4:
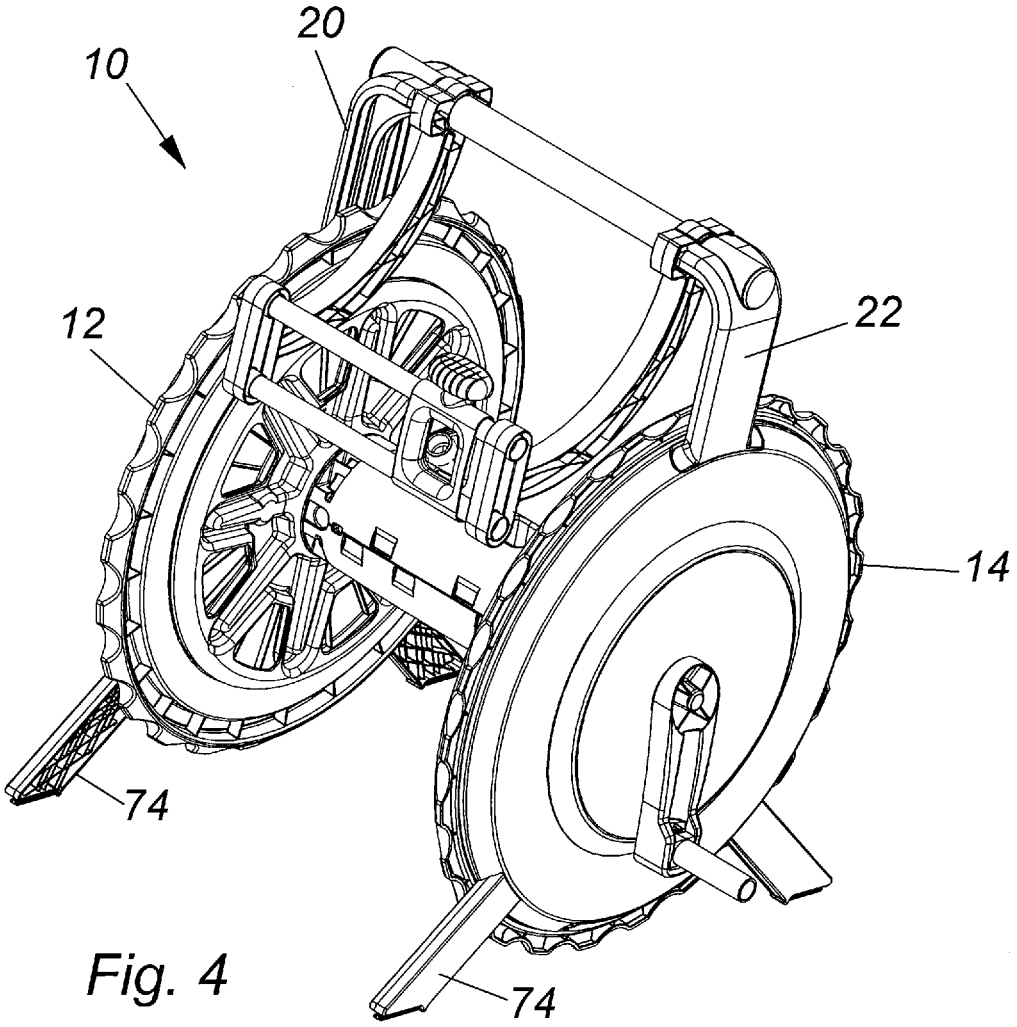
FIG. 4 is a front perspective view of the crank side of the mobile hose reel, shown in the stationary mode.
Figure 5:
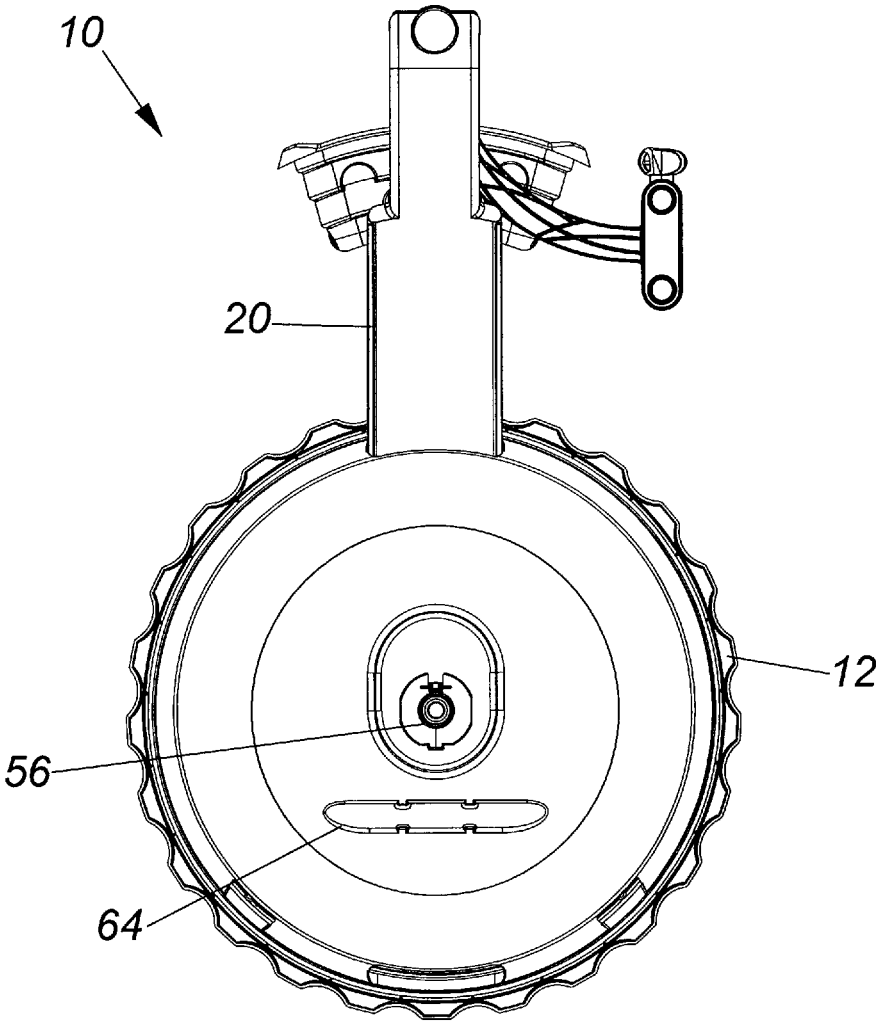
FIG. 5 is a left side view of the mobile hose reel, shown in the mobile mode.
Figure 6:
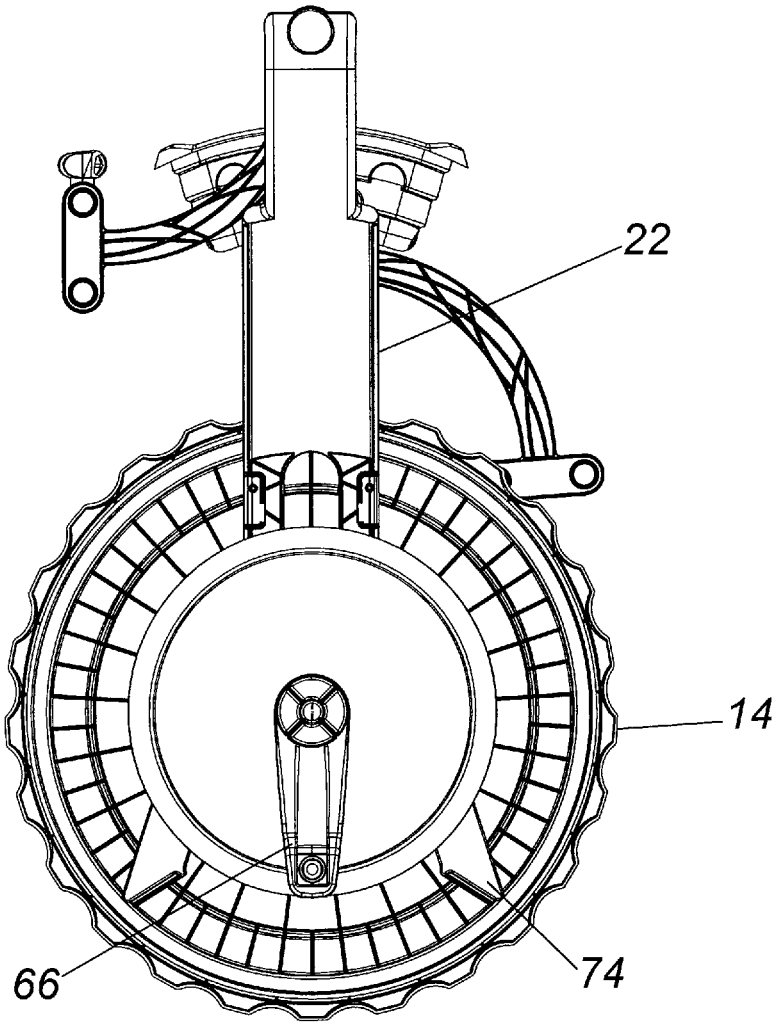
FIG. 6 is a right side view of the mobile hose reel, shown in the mobile mode.
Figure 7:
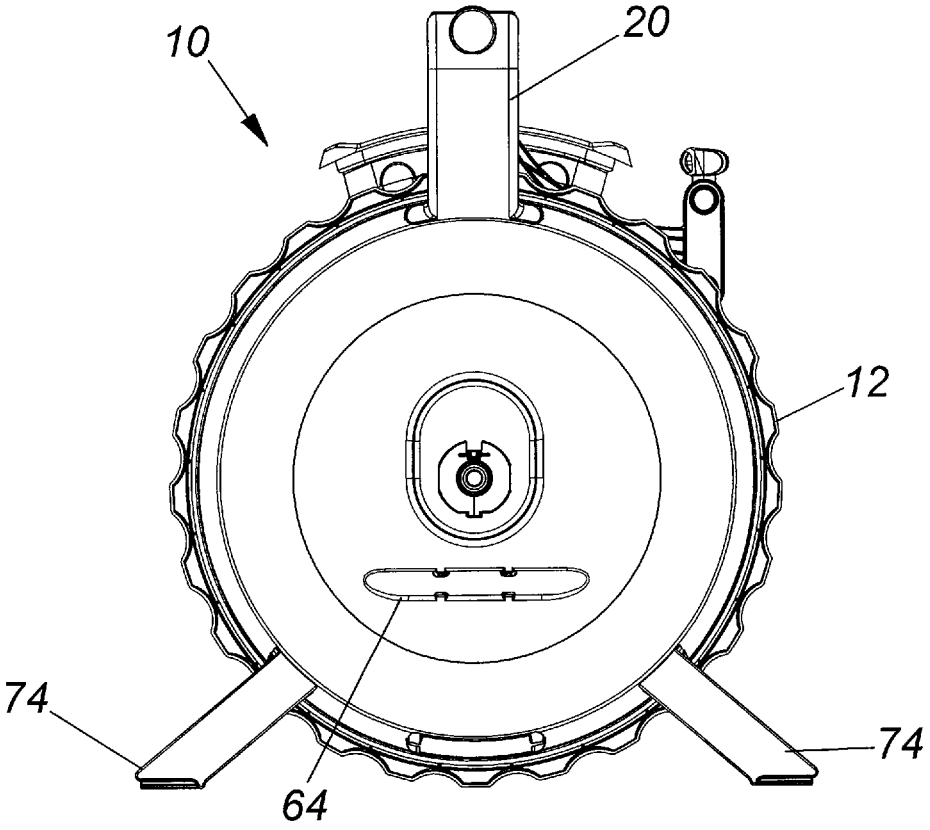
FIG. 7 is a left side view of the mobile hose reel, shown in the stationary mode.
Figure 8:
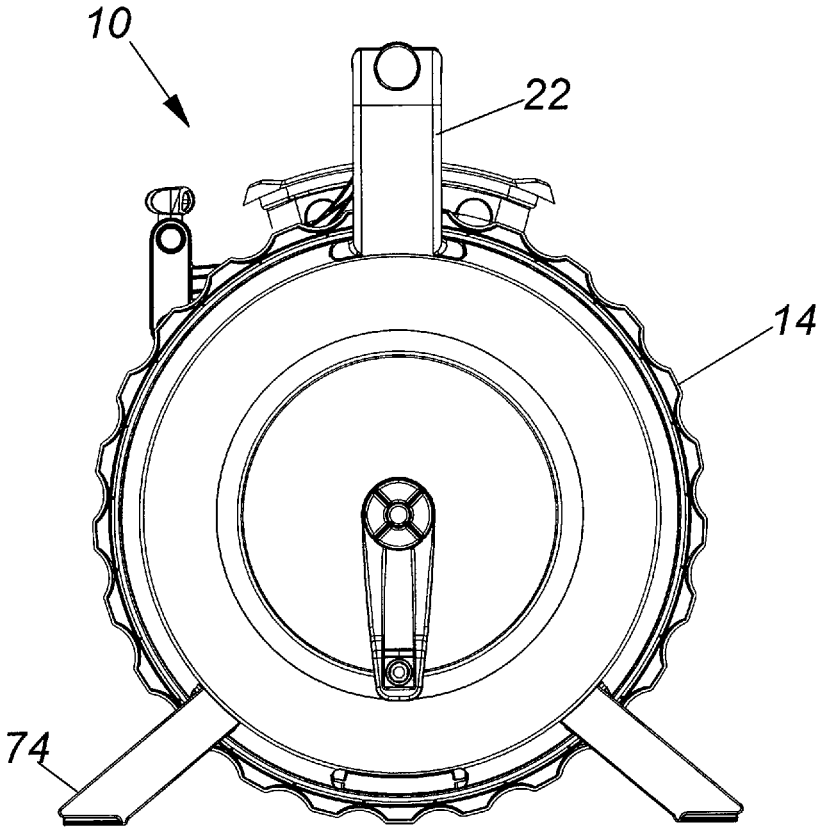
FIG. 8 is a right side view of the mobile hose reel, shown in the stationary mode.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-9B, an illustrative embodiment of a mobile hose reel, referred to generally as mobile hose reel 10, is shown. The mobile hose reel 10 is designed to be traversable between a mobile position and a stationary position. In the mobile position, the hose reel 10 is movable on a surface such as the ground or a paved or cemented surface; while in the stationary position, the hose reel 10 is stable and resting on such surfaces. The hose reel 10 contains a pair of rotatable side frame assemblies: a left side frame 12 and a right side frame 14. In the mobile position, the left side frame 12 and the right side frame 14 are configured to rotate independent of spool assembly flanges: a radial expanding, left spool assembly flange 16 and a radial expanding, right spool assembly flange 18. While the left side frame 12 and the right side frame 14 are shown having a circular profile, such shapes are illustrative only. Other profiles or shapes that allow the hose reel 10 to move about a surface can be used.

Figure 9A:
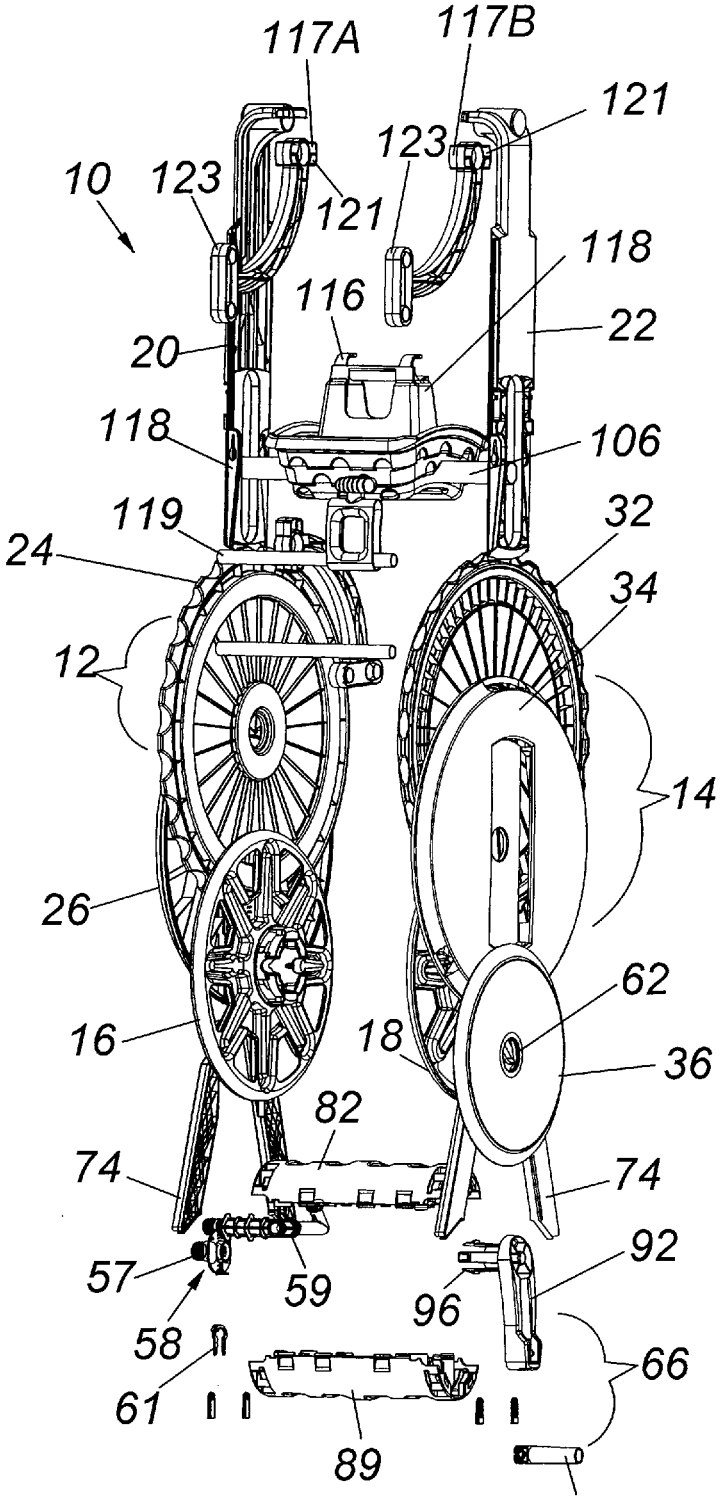
FIG. 9A is an exploded view of the mobile hose reel.
Figure 9B:
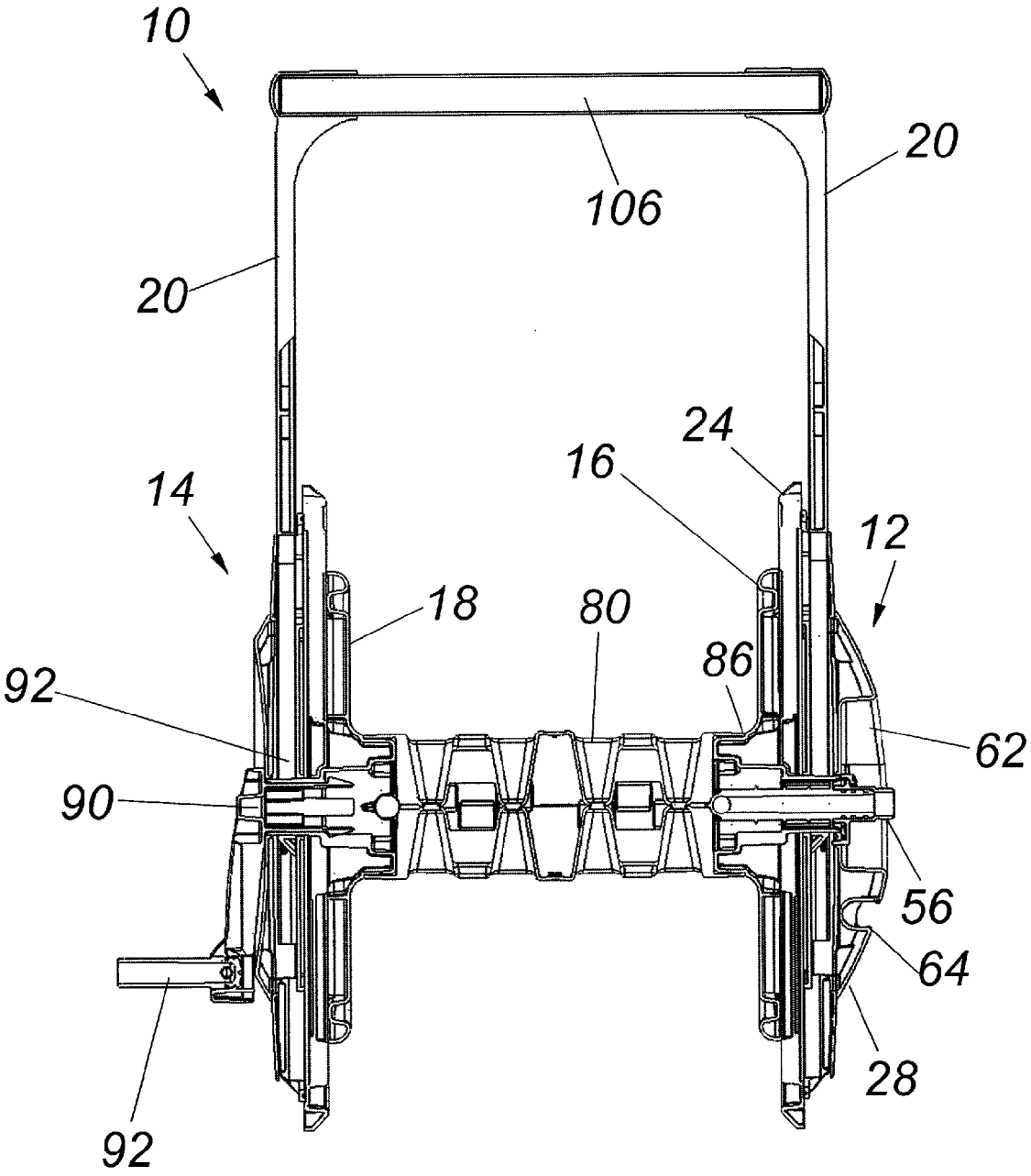
FIG. 9B is a cross sectional view of the mobile hose reel.
Figure 13:
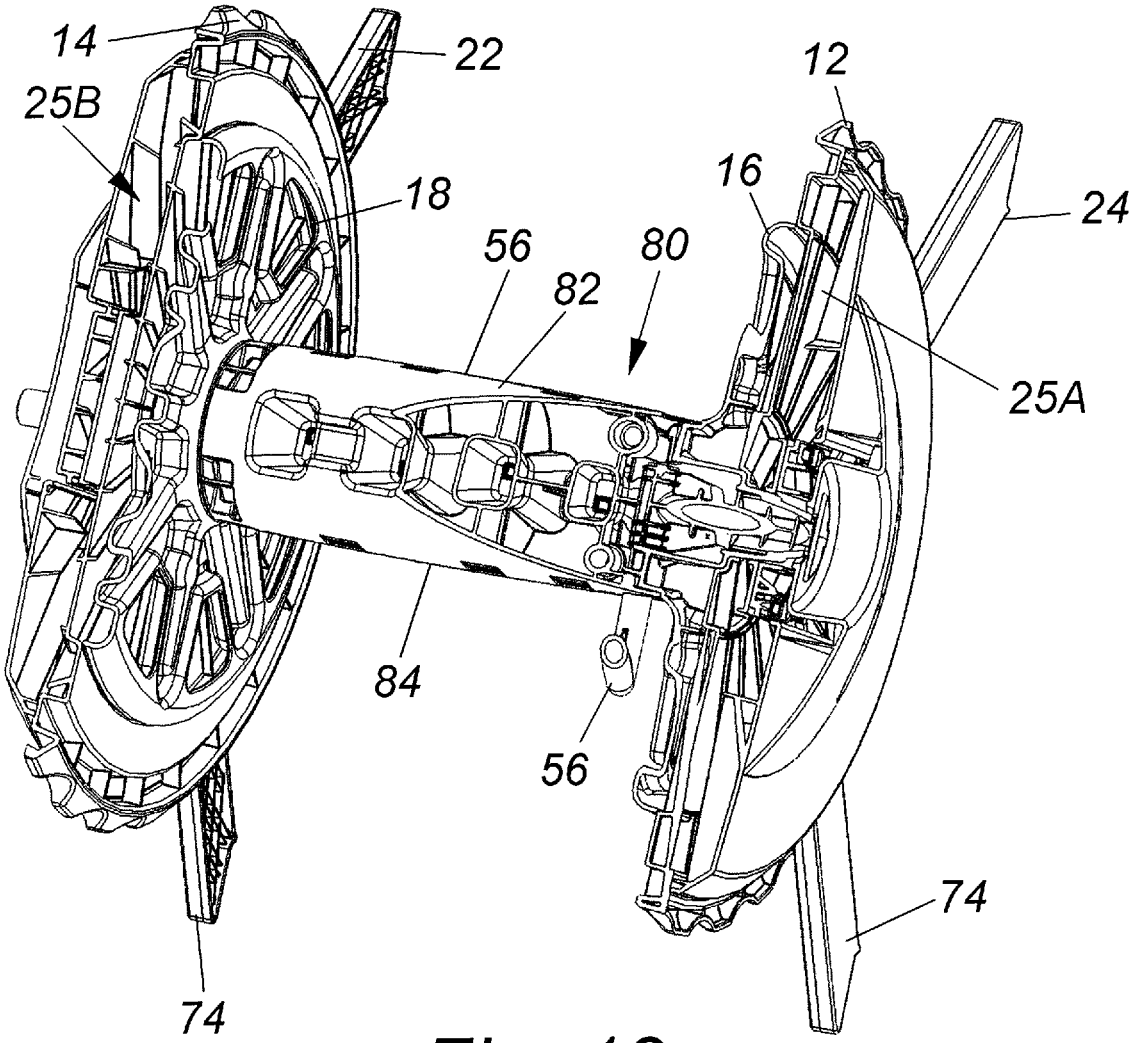
FIG. 13 is a partial cross sectional view illustrating attachment of the spool assembly to the left side frame and the right side frame.
Figure 16:
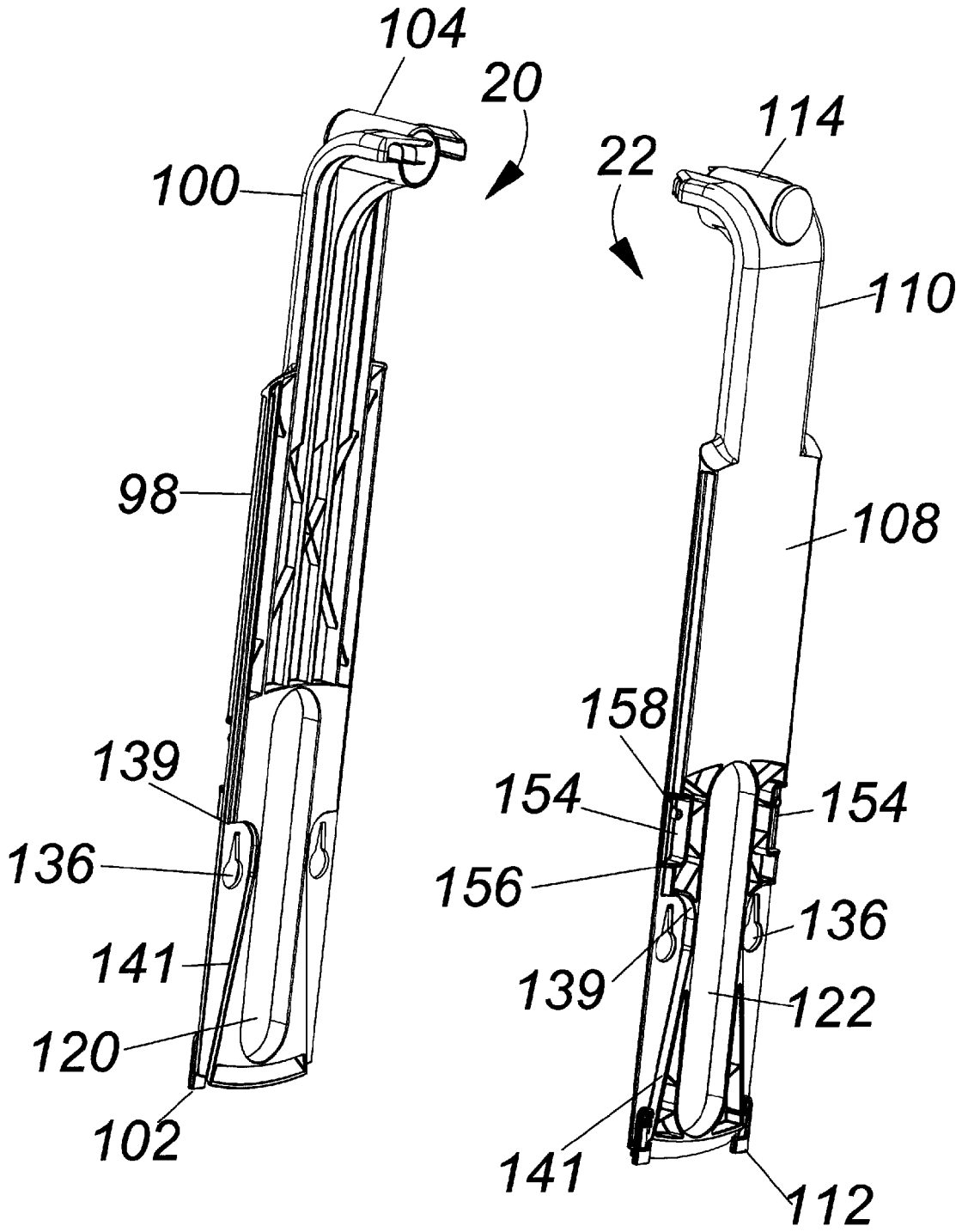
FIG. 16 is a perspective view of an illustrative embodiment of a right side arm and a left side arm.

Coupled to the rotatable left side frame 12 is a left side arm 20, illustrated herein as a side frame assembly elongated body, see for example FIG. 1, FIG. 9A, or FIG. 16. Coupled to the rotatable right side frame 14 is a right side arm 22, illustrated herein as a side frame assembly elongated body, see for example FIG. 1 or FIG. 9A. Both the left side arm 20 and the right side arm 22 can be sized and shaped to extend a predetermined distance when the hose reel 10 is traversed between the mobile position and the stationary position. As illustrated in FIG. 9A, the left side frame 12 is made of a first member 24, illustrated as a generally circular structure, secured to a second member 26, illustrated as a second generally circular structure. The left side frame first member 24 and the left side second member 26 are secured together to form an interior region 25A (see FIG. 13) defined by the space between the first member 24 and the second member 26. The interior space 25A is of sufficient size to receive the left arm 20. The left arm 20 is designed to move vertically, i.e. up or down, about the longitudinal axis 23 within the interior region 25A when a user traverses the hose reel 10 between the mobile position and the stationary position. A cap 28 (see FIG. 1) secures to the left side second member 26.

The right side frame 14 is made of a first member 32 secured to a second member 34. The right side frame first member 32 and the right side second member 34 are secured together to form an interior region 25B (see FIG. 13) defined by the space between the first member 32 and the second member 34. The interior region 25B is of sufficient size to receive the right arm 22. The right arm 22 is designed to move vertically within the interior region 25B when a user traverses the hose reel 10 between the mobile position and the stationary position. A cap 36 secures to the right side second member 34 (see FIG. 9A).

Figure 11:
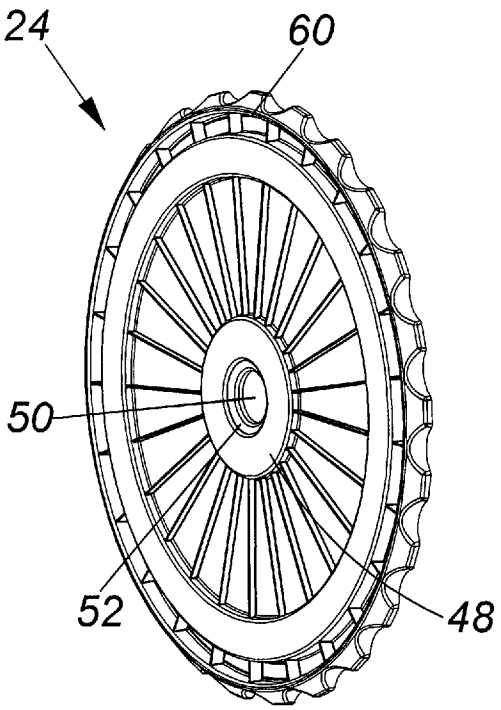
FIG. 11 is a perspective view of an interior side of the left side frame first member.
Figure 10:
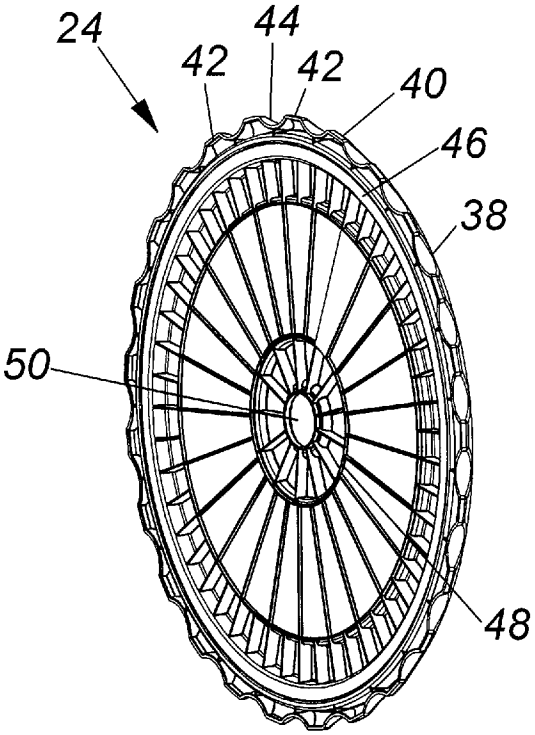
FIG. 10 is a perspective view of an exterior side of an illustrative embodiment of the left side frame first member.

An illustrative embodiment of the left side frame first member 24 is shown in FIG. 10 (exterior side, orientated away from the space between the left side frame 12 and the right side frame 14) and FIG. 11 (interior side, orientated towards the space between the left side frame 12 and the right side frame 14). The left side frame first member 24 is shown having a rounded or circular body 38. The body 38 has a circumferential reverse scalloping edge 40 to form a perimeter having a series of raised edge surfaces 42 between a series of trough-like rounded surfaces 44. An inner circumferential landing 46 is used to secure other components thereto. An interior center region 48 contains an opening 50 with threading 52 for securing to other components of the device, such as a spool assembly 56 containing an inlet/outlet fluid conduit assembly 58 (see FIG. 9A, 9B or FIG. 13) or a crank handle 66 (see FIG. 2 and FIG. 9). The inlet/outlet fluid conduit assembly, such as described in U.S. Pat. No. 8,801,047, the contents of which are herein incorporated by reference in its entirety, contains an inlet conduit 57 and a inlet/outlet swivel union conduit assembly 59 with clips 61 (see FIG. 9A). The inlet/outlet fluid conduit assembly provides a mechanism for transportation of a fluid from a fluid supply source, i.e. a water spigot, to a fluid dispensing source, such as a hose. A second inner circumferential landing 60 (FIG. 11) may be used to secure or align the body 38 to one or more components if required. As shown in FIG. 1, the cap 28 has a center, recessed cut-out portion 62. In addition, a recessed channel 64 is sized and shaped to fit and secure a hose (not shown). The right side frame first member 32, having the same features as described for the left side frame first member 24, is not described in detail. The cap 36 (see FIG. 9A) associated with the right side frame first member 32 may not include a recessed channel 64 when used with the right side frame first member second member 34. In addition, the center, recessed cut-out portion 62 may be sized and shaped to receive the crank handle assembly 66 (see FIG. 2 or FIG. 9A)

Figure 12:
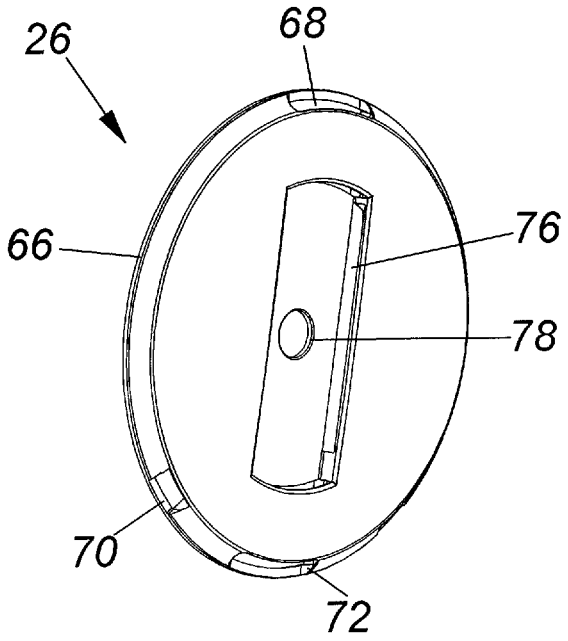
FIG. 12 is a perspective view of an illustrative embodiment of the left side frame second member.

An illustrative embodiment of the left side frame second member 26 is shown in FIG. 12. The right side frame second member 34, having the same features as described below, is not described in detail. The left side frame second member 26 comprises a rounded or circular body. Along the perimeter of the body 66 is a first slotted opening 68 sized and shaped to receive and hold the left arm 20. Additional slotted openings 70 and 72 are positioned on the lower side of the circumferential edge, and are sized and shaped to receive support legs 74. A recessed channel 76 sized and shaped to allow left arm 20 to slide therein maintains the arm 20 in position as the mobile hose reel 10 is traversed between the mobile position and the stationary position. Opening 78 is sized and shaped to receive one or more components of the spool assembly, inlet-outlet tube assembly, or crank assembly.

Figure 15:
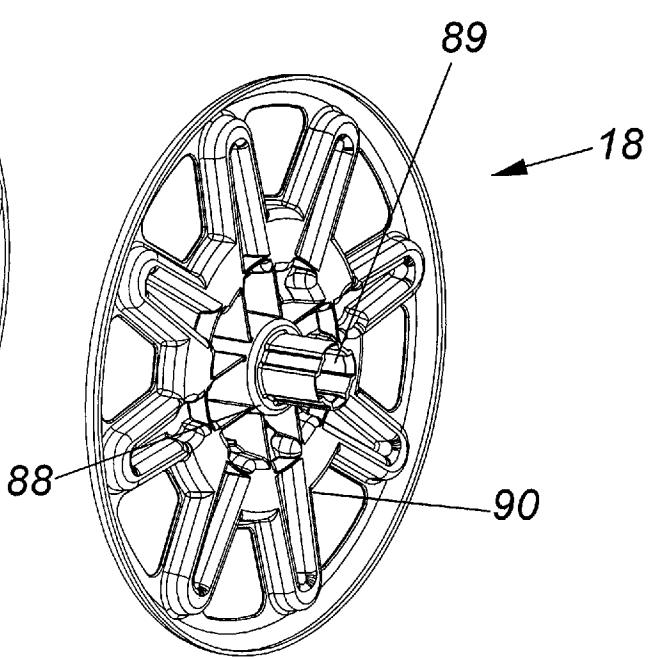
FIG. 15 is a perspective view showing a second side of the left hose reel assembly flange shown in FIG. 14.
Figure 14:
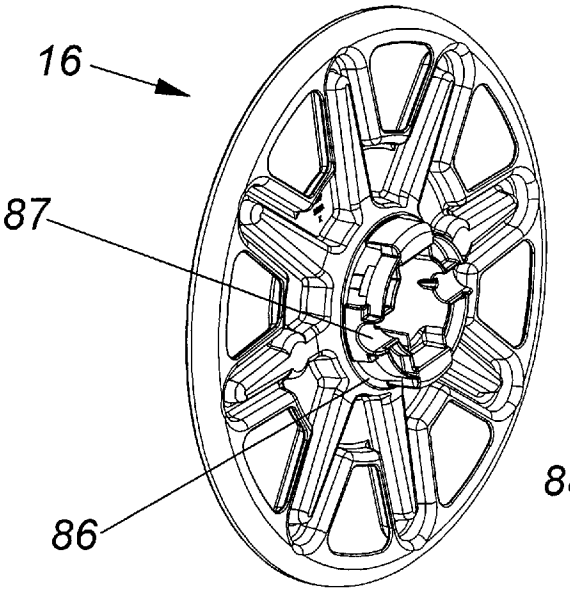
FIG. 14 is a perspective view of an illustrative embodiment of a left hose reel assembly flange.

The hose reel 10 is designed to allow for storage, up-take and distribution of a flexible hose using a spool assembly 56. The spool assembly 56 is defined by a hub 80 secured to the radially expanding left hose reel assembly flange 16 at one end and the radially expanding right hose reel assembly flange 18 at an opposing end of the hub 80. The hub 80 and the flanges 16 and 18 are configured to accommodate a flexible garden hose (not shown) wrapped around the hub 80. As illustrated, the hub 80 comprises an upper member 82 secured to a lower member 84, see FIG. 9A or FIG. 13. FIGS. 14 and 15 illustrate embodiments of the left hose reel assembly flange 16. The flange 16 has a body having a generally rounded or circular shape. The left hose reel assembly flange 16 has a spool assembly receiving member 86 configured to receive and secure to end portions of spool 80. Semi-circular cut out sections 87 are sized and shaped to secure portions of the inlet-outlet tube assembly 56 thereto. The left hose reel assembly flange 16 may also contain a cylindrical post 90 extending outwardly from its body, and located on the opposite side of spool assembly receiving member 86. The cylindrical post 90 contains a hollow interior 89 configured to receive a crank handle body 92. The crank handle body 92 is snapped into position using snap lock pins 96, see FIG. 9B. In this configuration, the crank handle 92 rotates the spool assembly 56. The cylindrical post 90 may also act as a pivoting axis for independent rotation of the left side frame 12 and the right side frame 14.

FIG. 16 shows illustrative embodiments of the left side arm 20 and the right side arm 22. The left side arm 20 is shown having an elongated body 98 having an upper end 100 and a lower end 102. The upper end 100 contains a cross bar receiving area, shown as an open cylindrical body 104 sized and shaped to receive an end portion of a cross bar 106 (see FIG. 1 and FIG. 9A and FIG. 9B). The right side arm 22 is shown having an elongated body 108 having an upper end 110 and a lower end 112. The upper end 110 contains a cross bar receiving area, shown as an open cylindrical body 114 sized and shaped to receive a second end portion of the cross bar 106. Optionally, attached to the cross bar 106 via c-shaped clasps 116 is a basket 118 (see FIG. 9A). A stability bar assembly 115 may also be secured to the cross bar 106 or a portion of the arms 20 and 22. The stability bar assembly 115 comprises two semi curved bars 117A and 117B secured to linking bar 119. Each semi-curved bar 117A and 117B contains an opening 121 for securing to the cross bar 106 at one end and a clamping end 123 configured to secure to the linking bar 119. Each side arm 20 and 22 contains an elongated open slot 120 and 122, allowing a mechanism to provide for each arm to slidably engage with other components of the hose reel 10, i.e. the crank handle assembly or the inlet-outlet tube. Accordingly, each arm 20 and 22 can be moved upwardly and downwardly to traverse between the two modes, the mobile mode and the stationary mode. Each arm 20 and 22 is further configured to secure to stability legs 74.

Figures 17, 18:
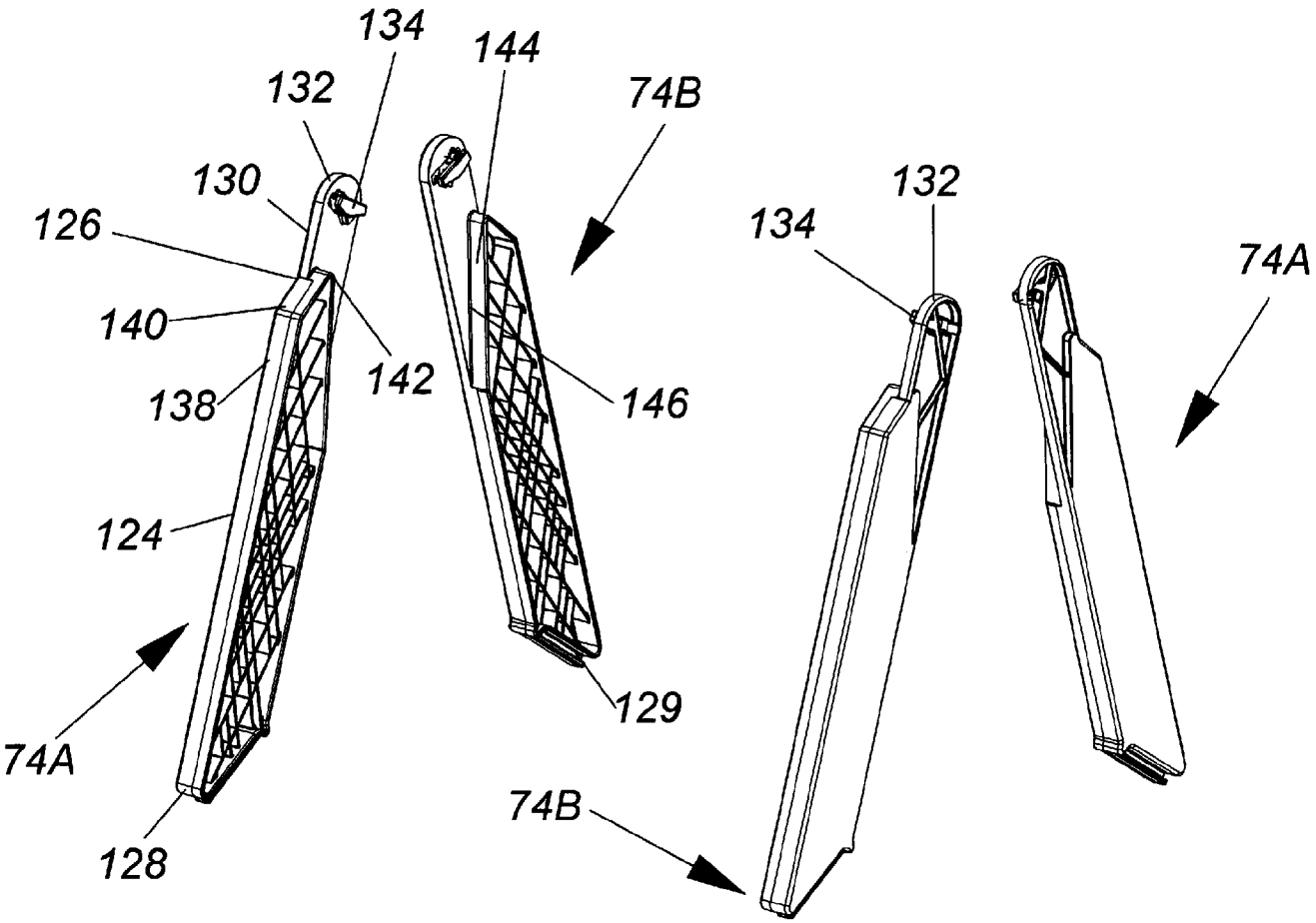
FIG. 17 is a perspective view of an illustrative embodiment of stability legs.
FIG. 18 is an alternative perspective view of the stability legs.

The stability legs 74 (see FIGS. 17 and 18) are sized and shaped to rest within the inner space between the left side frame first member 24 and the left side frame second member 26 or the space between the right side frame first member 32 and the right side frame second member 34 when in the mobile mode. FIG. 17 is a perspective view of a pair of stability legs 74, and labeled as 74A and 74B when describing an individual leg, showing the interior surface side. FIG. 18 is a perspective view of the pair of stability legs 74A and 74B showing the exterior surface side. Each leg 74 comprises an elongated body 124 having a first side 126 coupled to the left side arm 20 or right side arm 22 and a second, opposing side 128 for securing or contacting a surface such as the ground. Extending upwardly from the first side 126 is a rectangular extension member 130 terminating in a partially circular surface 132. The rectangular extension member 130 contains a stability leg locking member 134 sized and shaped to fit within a side arm stability member receiving member 136 (see FIG. 16) positioned on the left side arm 20 or right side arm 22.

The stability leg locking member 134 may contain a plurality of angled surfaces or be secured to the arm 20/22 at an angle so that, when the arm rotates, the stability leg locking member 134 is properly orientated with the side arm stability member receiving member 136 to lock in place. The stability leg locking member 134 (first member of a leg to arm locking assembly) and side arm stability member receiving member 136 (second member of a leg to arm locking member) form a leg to arm locking assembly.

Figure 19A:
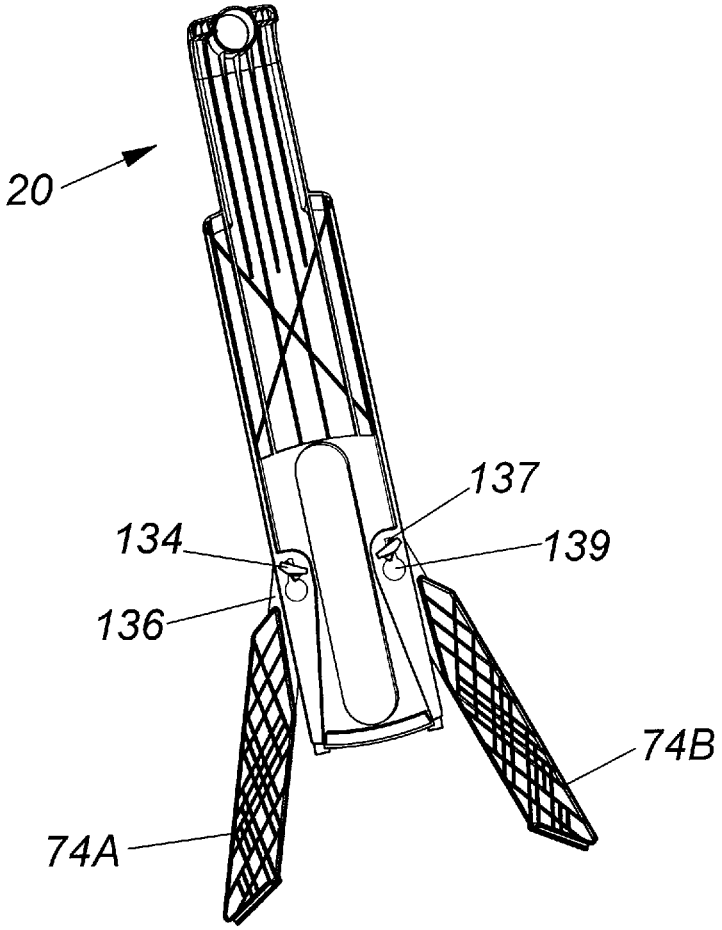
FIG. 19A illustrates stability legs secured to a side arm.
Figure 19B:
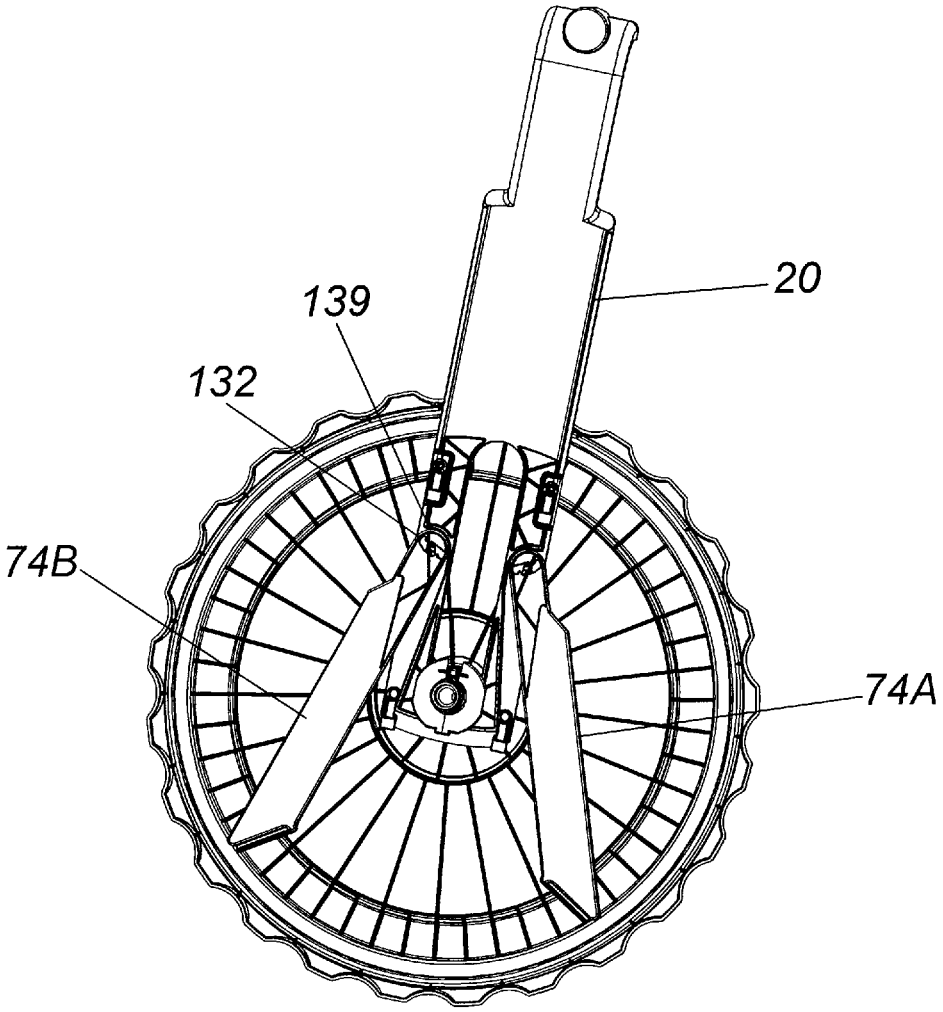
FIG. 19B illustrates an alternative view of the stability legs being attached to a side arm, with a segment of the inlet-outlet assembly inserted through a portion of the arm.

The side arm stability member receiving member 136 is shown having a key hole shape to allow for the stability leg locking member 134 to be inserted therein and locked in position. FIG. 19A or 19B illustrates the left side arm 20 with stability legs 74A and 74B secured through side arm lock receiving member 136. As shown, the stability leg locking member 134 is secured to an elongated channel 137 of the side arm lock receiving member 136 in the mobile position, holding it in place (mobile locking position). As the left side arm 20 is moved downward to place the stability legs 74A and 74B in the stationary position, the stability leg locking member 134 rotates and moves downward to rest within the circular region 139, locking the stability legs 74A and 74B in the stationary position (stationary locking position). As the stability legs 74 are traversed between the stationary locking position and the mobile locking position, the partially circular surface 132 rotates against a corresponding circular surface 139 located on both sides of arm 20 or arm 22. The circular surface 139 allows the partially circular surface 132 to rotate freely against the arm portion. Each arm 20, 22 further contains an angled surface 141 (FIG. 16) on either side to help guide the stability legs 74A and 74B as they move inwardly or outwardly based on the positioning of arm 20 or 22.

The stability leg 74 contains an outer surface edge 138 that contains an inwardly angled surface terminating in an apex 142. A second angled surface 142 extends downwardly from the apex 142, across the inner surface 146 of the leg 74. The angled surfaces 140 or 146 are used to guide the leg 74 to the proper positioning or orientation when traversing between the mobile mode and the stationary mode. The opposing side 128 is sized and shaped to allow the leg to rest securely on a desired surface, maintaining the mobile hose reel 10 in a stable, upright position or orientation. This prevents the mobile hose reel 10 from tipping over during use. Leg 74 may contain a cutout region, forming a recessed channel to aid in securing to a surface.

The portable hose reel 10 is further described by providing an illustrative example of how the device functions. The portable hose reel 10 may be used in the stationary mode, see FIGS. 3 and 4. In this mode, the arms 20 and 22 are positioned in the interior region defined by the right side frame first member 32 and the right side second member 34 and the interior region defined by the left side frame first member 24 and the left side second member 26. In this position, the user can wind/unwind the hose which has been wrapped around spool 80. If a user wishes to move the portable hose reel 10 to a different location, the hose may be wound around the spool using the crank handle body assembly 92. The spool is designed to move independently from movement of the left side frame 12 and the right side frame 14. A user may grab the portable hose reel 10 either by the cross bar 106 or by the stability assembly 115 to extend the arms 20 and 22 in an upward direction (i.e. towards the head of the user). This action moves portions of the arms 20 and 22 through the interior region defined by the right side frame first member 32 and the right side second member 34 and through the interior region defined by the left side frame first member 24 and the left side second member 26. Arms 74A and 74B move from the locked stationary position to the locked mobile position.

Figure 20:
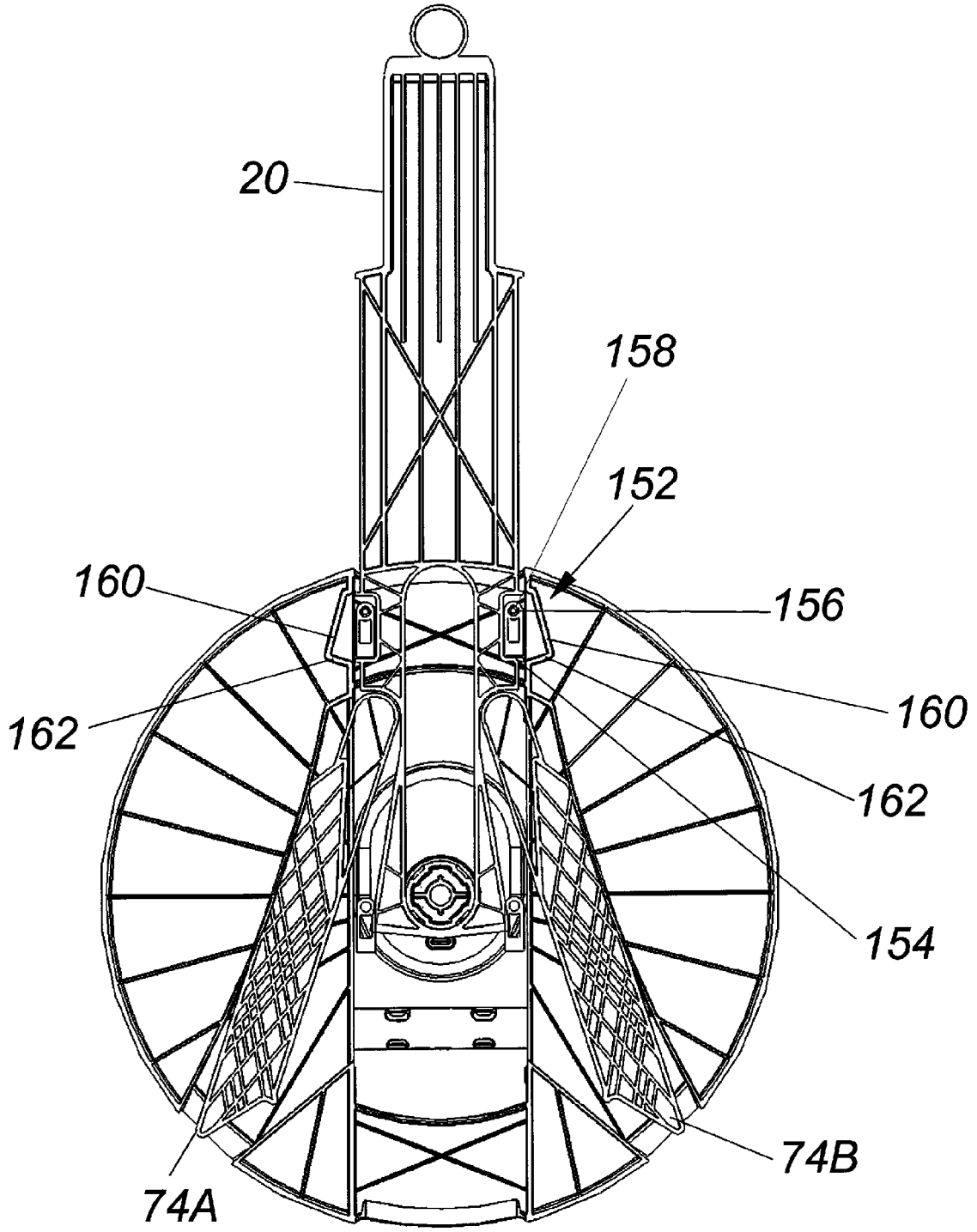
FIG. 20 illustrates a side arm in a tipped position.

Each arm 20 and 22 can be tipped by rotating in a direction indicated by arrows 150A or 150B (FIG. 1) to aid in moving the portable hose reel 10. As the arms 20 and 22 are tipped, the arms can be automatically locked in place by an interior handle locking mechanism 152, see FIG. 20. FIG. 20 shows an arm 20 in a tipped position using an interior locking mechanism 152. Each arm 20 and 22 comprise a first component of an interior locking mechanism 152. On each side of the arm 20 is a first component of an interior locking mechanism, illustrated herein as an interior arm locking member recessed member 154 having a seat 156. Within the interior arm locking member recessed member 154 is housed a locking member 156 held in place by pin 158.

As arms 20 and 22 are tipped, the locking member 156 swings about pin 158 and rests in a second component of the interior locking mechanism 152 positioned within the side frames 12 and 14. The second component of the interior locking mechanism 152 is illustrated herein as side frame locking member 160 having seat 162. The side frame locking member 160 is orientated to align with the interior arm locking member recessed member 154 so that, when the locking member 156 rotates about the pin 158, it rests on seat 162, secured within the side frame locking member 160. This position allows the side frame 12 and 14 to rotate as the user pushes the portable hose reel 10 along a surface. The arms can then be returned to a stationary position when the portable hose reel 10 is returned to vertical. Once at the proper place, the arms 20 and 22 can be moved upright and pushed downward so the stability arms 74 are moved out of the side frame 12 and 14.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A mobile hose reel traversable between a mobile mode and a stationary mode comprising:

a first side frame assembly comprising a rotatable side wall configured to rotate a sufficient distance to move said mobile hose reel about a surface, said rotatable side wall having a first member secured to a second member to form an interior space therebetween, and a first side frame assembly arm traversable within said interior space and comprising a pair of rotatably attached legs thereto, said pair of legs having a sufficient length to extend out of said rotatable side wall when in a stationary position and rest within said rotatable side wall when in a mobile position;

a second side frame assembly comprising a rotatable side wall configured to rotate a sufficient distance to move said mobile hose reel about a surface, said rotatable side wall having a first member secured to a second member to form an interior space therebetween, and a second side frame assembly arm traversable within said interior space and comprising a pair of rotatably attached legs thereto, said pair of legs having a sufficient length to extend out of said rotatable side wall when in said stationary position and rest within said rotatable side wall when in said mobile position;

a spool assembly comprising a hub having a first radial expanding flange attached at one end and a second radial expanding flange at a second end.

2. The mobile hose reel according to claim 1 wherein said spool assembly is configured to rotate independently of movement of said first side frame assembly or said second side frame assembly.

3. The mobile hose reel according to claim 1 wherein said first member of said first rotatable side wall comprises a channel sized and shaped to guide said first side frame assembly arm as it traverses within said first side frame assembly; and said first member of said second rotatable side wall comprises a channel sized and shaped to guide said second side frame assembly arm as it traverses within said second side frame assembly.

4. The mobile hose reel according to claim 1 wherein each said pair of legs comprises a first member of a leg to arm locking assembly configured to engage with a second member of a leg to arm locking member associated with said first side frame assembly arm or said second side frame assembly arm;

whereby said leg to arm locking assembly maintains positioning of each said leg relative to said first side frame assembly arm or said second side frame assembly arm when in said mobile position or said stationary locking position.

5. The mobile hose reel according to claim 1 further including a cross bar connecting said first side frame assembly arm and said second side frame assembly arm.

6. The mobile hose reel according to claim 1 wherein each of said first side frame assembly arm and said second side frame assembly arm contains a curved surface configured to guide said leg as said leg is rotated.

7. The mobile hose reel according to claim 1 wherein each of said first side frame assembly arm and said second side frame assembly arm is further positionable at an angle from a longitudinal axis.

8. The mobile hose reel according to claim 1 further including a first side frame assembly arm self locking mechanism for mating said first side frame assembly arm in an angled position, said first side frame assembly arm self-locking mechanism comprising a first locking member rotatable coupled to said first side frame assembly arm, and a side frame locking member having a seat sized and shaped to receive said first locking member; and a second side frame assembly arm self locking mechanism for mating said second side frame assembly arm in an angled position, said second side frame assembly arm self-locking mechanism comprising a second locking member rotatable coupled to said second side frame assembly arm, and a second side frame locking member having a seat sized and shaped to receive said second locking member.

9. The mobile hose reel according to claim 1 wherein the first radial expanding flange is adjacent said first rotatable side wall, and said second radial expanding flange is adjacent said rotatable side wall.

10. A mobile hose reel traversable between a mobile mode and a stationary mode comprising:

a first side frame assembly comprising a first rotatable side wall configured to rotate a sufficient distance to move said mobile hose reel about a surface and a first side frame assembly elongated body, said first side frame assembly elongated body sized and shaped to slidably move within at least a portion of said first rotatable side wall, said first side frame assembly elongated body having a first portion configured to secure to a first end of an elongated cross bar and a second portion configured to secure to a first pair of deployable stability members, said first pair of deployable stability members configured to extend out of said first rotatable side wall when in a stationary position and rest within said rotatable side wall when in a mobile position;

a second side frame assembly comprising a second rotatable side wall configured to rotate a sufficient distance to move said mobile hose reel about a surface and a second side frame assembly elongated body, said second side frame assembly elongated body sized and shaped to slidably move within at least a portion of said second rotatable side wall, said second side frame assembly elongated body having a first portion configured to secure to a second end of an elongated bar and a second portion configured to secure to a second pair of deployable stability members, said second pair of deployable stability members configured to extend out of said second rotatable side wall when in said stationary position and rest within said rotatable side wall when in said mobile position; and a spool assembly comprising a hub having a first radial expanding flange attached at one end and a second radial expanding flange at a second end, said hub sized and shaped to receive an elongated flexible hose;

whereby traversal of said first side frame assembly and said second side assembly upwardly or downwardly about a longitudinal axis traverses said mobile hose reel between a mobile orientation and a stationary orientation.

11. The mobile hose reel according to claim 10 wherein said spool assembly further includes a crank handle operatively coupled to at least one radial expanding flange and an inlet-outlet tube assembly.

12. The mobile hose reel according to claim 10 wherein said spool assembly is configured to rotate independently of rotation of said first rotatable side wall or said second rotatable side wall.

13. The mobile hose reel according to claim 10 wherein said first pair of stability members are rotatably secured to said first side frame assembly elongated body and said second pair of stability members are rotatably secured to said second side frame assembly elongated body.

14. The mobile hose reel according to claim 10 wherein said first side frame assembly elongated body and said second side frame assembly elongated body are traversable about the circumference of said first rotatable side wall and said second side frame assembly elongated body is traversable about the circumference of said second rotatable side wall.

15. The mobile hose reel according to claim 14 further including a first side frame assembly arm self locking mechanism for mating said first side frame assembly arm in an angled position, said first side frame assembly arm self-locking mechanism comprising a first locking member rotatable coupled to said first side frame assembly arm, and a side frame locking member having a seat sized and shaped to receive said first locking member; and a second side frame assembly arm self locking mechanism for mating said second side frame assembly arm in an angled position, said second side frame assembly arm self-locking mechanism comprising a second locking member rotatable coupled to said second side frame assembly arm, and a second side frame locking member having a seat sized and shaped to receive said second locking member.

16. The mobile hose reel according to claim 15 wherein said self-locking mechanism including at least a first portion provided within said first side frame assembly elongated body or said second side frame assembly elongated body, at least one corresponding second portion positioned within said first side frame assembly or said second side frame assembly elongated body, and a securing member pivotally coupled to said first side frame assembly elongated body or said second side frame assembly elongated body.

17. The mobile hose reel according to claim 10 wherein said first side frame assembly elongated body and said second side frame assembly elongated body each contain a slotted region.

18. The mobile hose reel according to claim 10 wherein said at least one of said first side frame assembly or said second side frame assembly contains a cap secured to said rotatable side wall.

19. The mobile hose reel according to claim 18 wherein said cap comprises a slotted region sized and shaped to receive and hold a portion of a flexible hose.

* * * * *